US007527839B2

(12) United States Patent
Busche et al.

(10) Patent No.: US 7,527,839 B2
(45) Date of Patent: May 5, 2009

(54) EASY OPEN HEAT-SHRINKABLE PACKAGING

(75) Inventors: David A. Busche, Neenah, WI (US); Gregory Robert Pockat, Ripon, WI (US); Thomas Andrew Schell, Oshkosh, WI (US)

(73) Assignee: Curwood, Inc., Oshkosh, WI (US)

( * ) Notice: Subject to any disclaimer, the term of this patent is extended or adjusted under 35 U.S.C. 154(b) by 0 days.

(21) Appl. No.: 10/645,186

(22) Filed: Aug. 21, 2003

(65) Prior Publication Data

US 2004/0166262 A1 Aug. 26, 2004

Related U.S. Application Data

(63) Continuation-in-part of application No. 10/371,950, filed on Feb. 20, 2003, now abandoned.

(51) Int. Cl.

| | |
|---|---|
| ***B32B 27/08*** | (2006.01) |
| ***B65D 30/08*** | (2006.01) |
| ***B65D 53/00*** | (2006.01) |
| ***B65D 65/26*** | (2006.01) |

(52) U.S. Cl. ..... 428/34.9; 428/35.2; 428/35.4; 428/35.7; 428/36.6; 428/36.7; 383/109; 383/210

(58) Field of Classification Search ..... 428/34.1, 428/34.8, 34.9, 35.1, 35.2, 35.4, 35.5, 35.7, 428/36.6, 36.7, 36.92; 383/210, 210.1, 211, 383/107, 109, 113, 118, 205

See application file for complete search history.

(56) References Cited

U.S. PATENT DOCUMENTS

| | | | | |
|---|---|---|---|---|
| 3,900,534 | A | 8/1975 | Schard | |
| 4,690,843 | A | 9/1987 | Inagaki | |
| 4,729,476 | A | 3/1988 | Lulham et al. | |
| 4,798,751 | A | 1/1989 | Schuetz | |
| 4,875,587 | A | 10/1989 | Lulham et al. | |
| 4,944,409 | A | 7/1990 | Busche et al. | |
| 5,023,121 | A | 6/1991 | Pockat et al. | |
| 5,089,073 | A | 2/1992 | Schrimer | |
| 5,759,648 | A | 6/1998 | Idlas | |
| 5,888,648 | A * | 3/1999 | Donovan et al. | 428/349 |
| 5,928,740 | A | 7/1999 | Wilhoit et al. | |
| 6,206,569 | B1 | 3/2001 | Kraimer et al. | |
| 6,221,410 | B1 * | 4/2001 | Ramesh et al. | 426/105 |
| RE37,171 | E | 5/2001 | Busche et al. | |
| 6,511,688 | B2 | 1/2003 | Edwards et al. | |
| 6,630,237 | B2 | 10/2003 | Rivett et al. | |
| 6,682,825 | B1 | 1/2004 | Kennedy et al. | |
| 7,045,183 | B2 | 5/2006 | Amano et al. | |
| 7,393,593 | B2 | 7/2008 | Roussos | |

(Continued)

FOREIGN PATENT DOCUMENTS

| | | |
|---|---|---|
| DE | 11 54 760 B | 9/1963 |

(Continued)

*Primary Examiner*—Rena L Dye
*Assistant Examiner*—Walter B Aughenbaugh
(74) *Attorney, Agent, or Firm*—Cedric M. Richeson; Christine E. Parsons

(57) ABSTRACT

An easy opening heat-shrinkable bag adapted to be heat sealed to a closed condition to contain and protect a product disposed therein, whereby, at least one heat seal is peelable and readily openable by application of force.

60 Claims, 8 Drawing Sheets

U.S. PATENT DOCUMENTS

2001/0051200 A1 12/2001 Noel et al.

FOREIGN PATENT DOCUMENTS

| | | | |
|---|---|---|---|
| EP | 0 435 498 | A | 3/1991 |
| EP | 0 511 171 | A1 | 10/1992 |
| EP | 0 696 542 | B1 | 11/1998 |
| EP | 0 913 338 | A | 6/1999 |
| FR | 2 841 223 | A | 12/2003 |
| WO | WO 2007/064326 | A1 | 6/2007 |
| WO | WO 2007/088005 | A1 | 8/2007 |

* cited by examiner

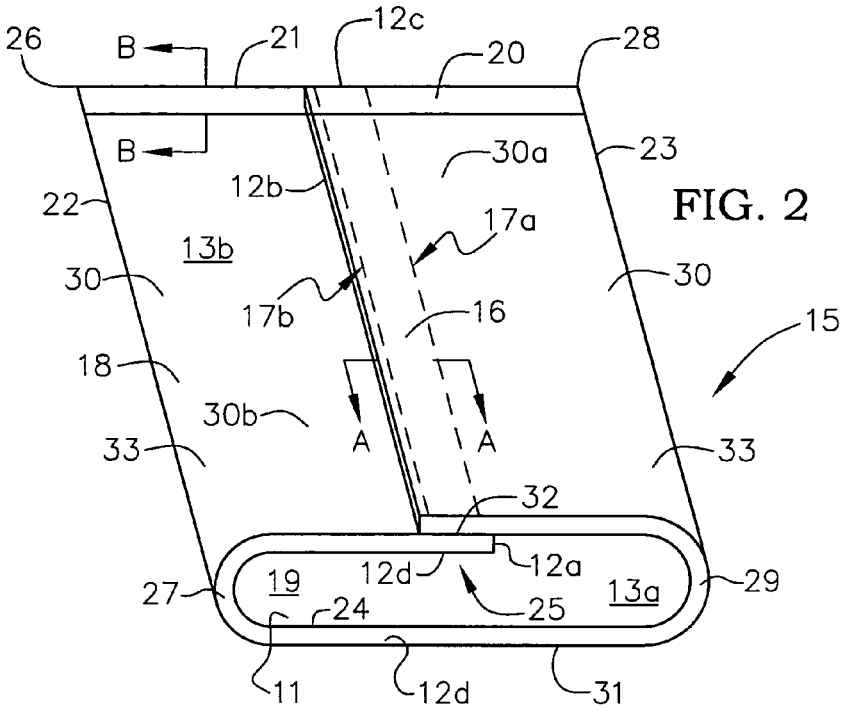
FIG. 2
FIG. 1
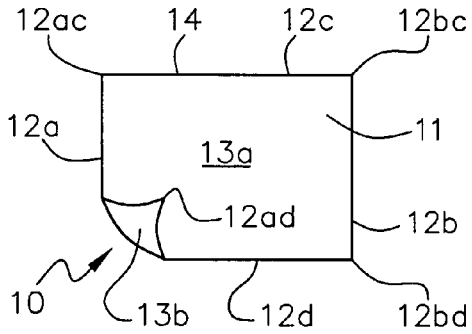
FIG. 3
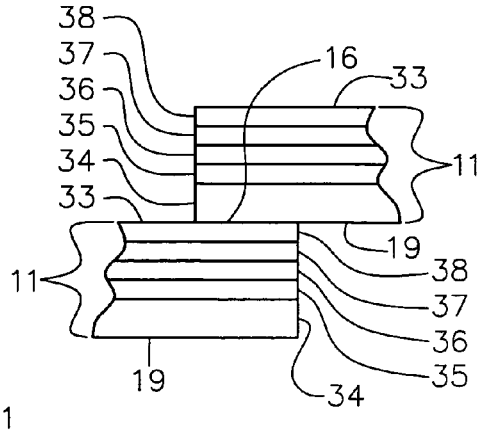
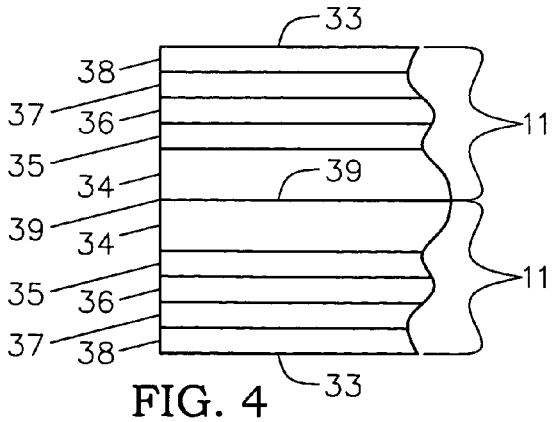
FIG. 4

FIG. 10
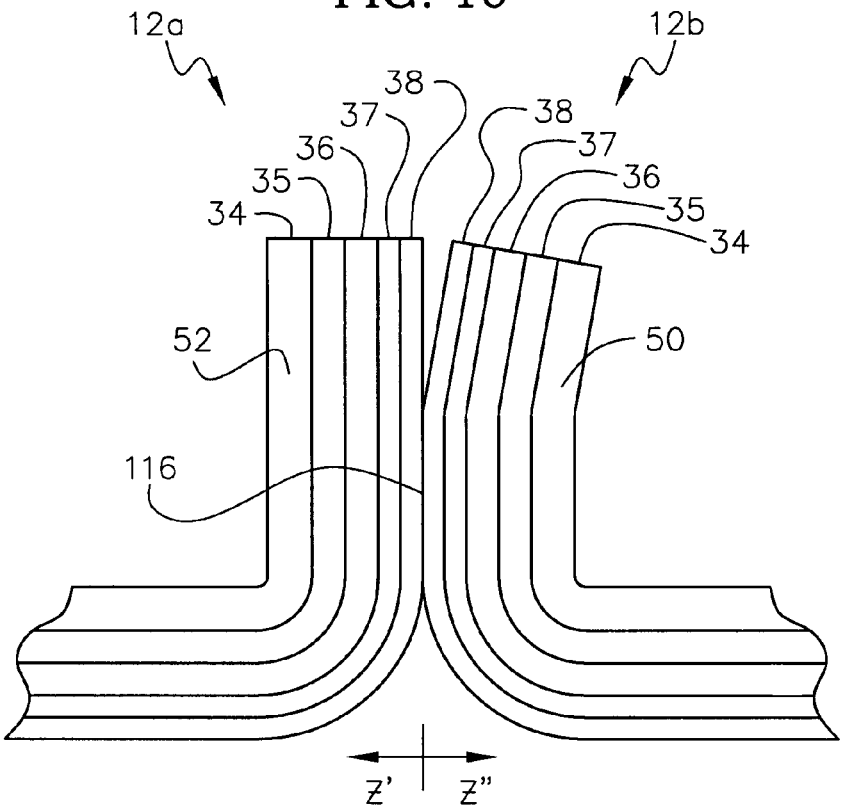
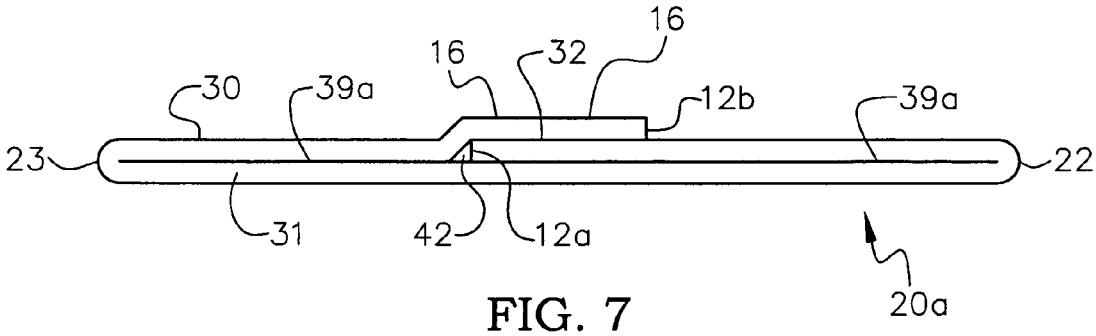
FIG. 7

FIG. 11
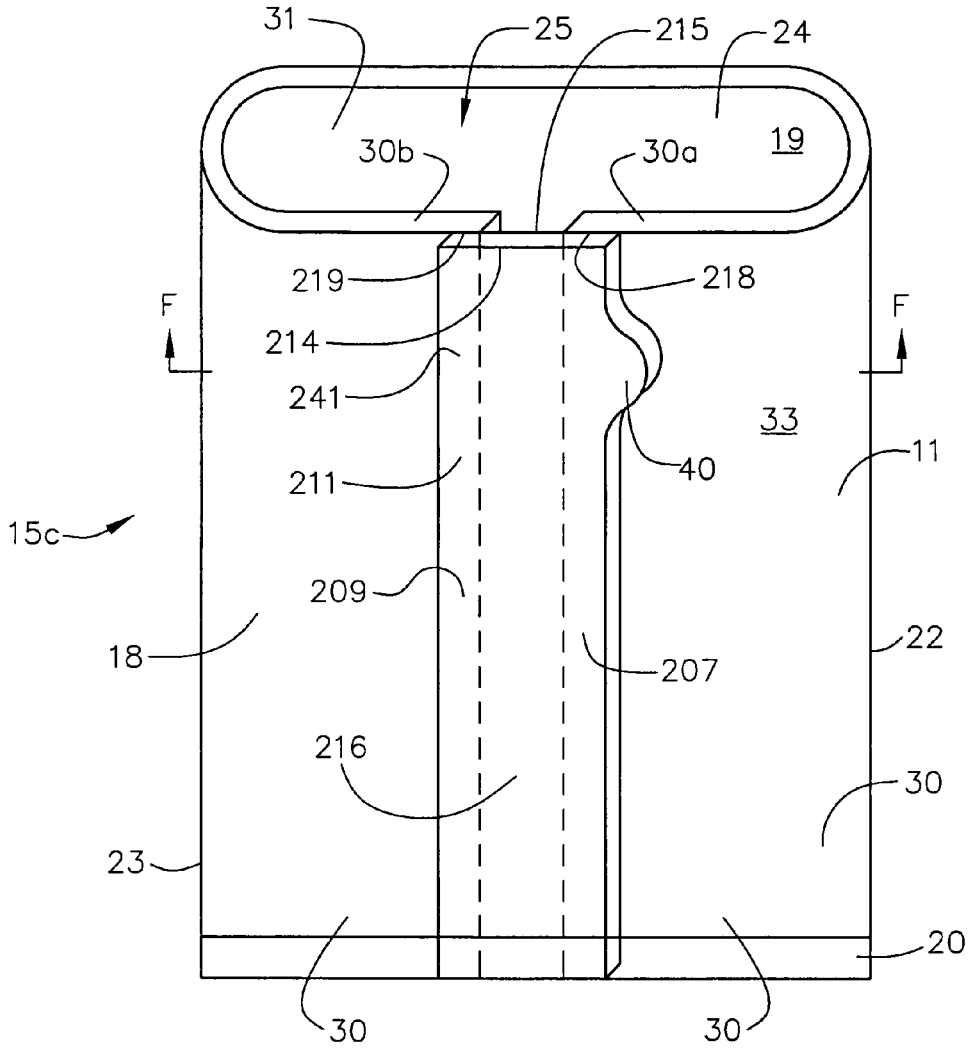
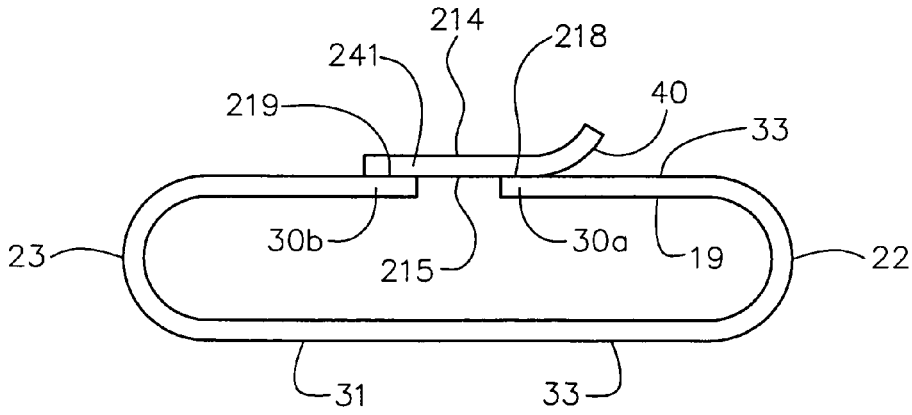
FIG. 12

FIG. 13
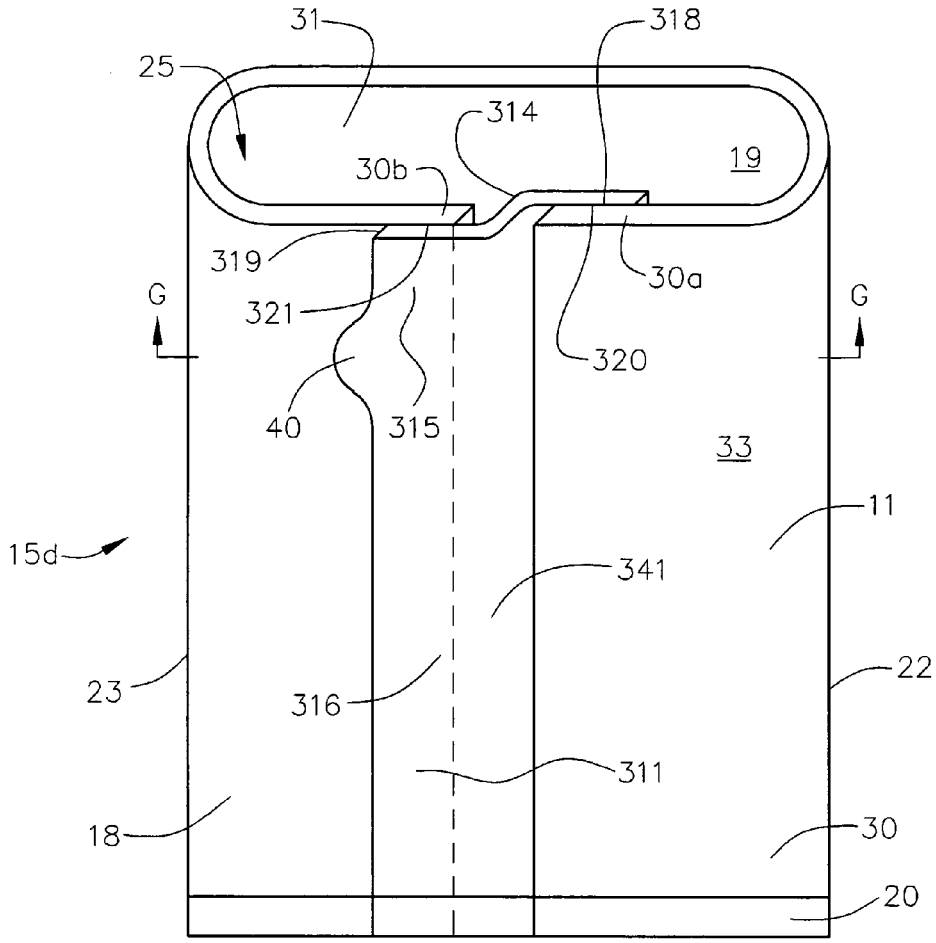
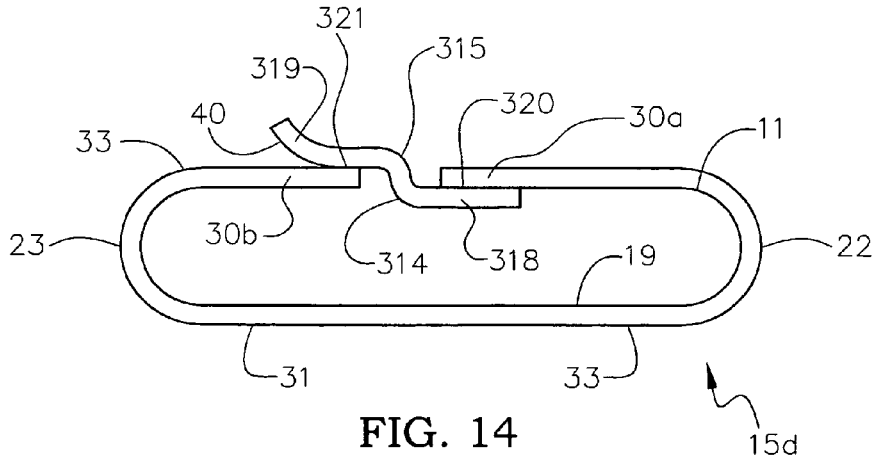
FIG. 14

EASY OPEN HEAT-SHRINKABLE PACKAGING

CROSS-REFERENCE TO RELATED APPLICATIONS

This application is a continuation-in-part application claiming the benefit of U.S. patent application Ser. No. 10/371,950 filed Feb. 20, 2003, now abandoned which is incorporated herein in its entirety.

BACKGROUND OF THE INVENTION

This invention relates generally to packaging and specifically to hermetically heat sealable, easy open, heat-shrinkable packaging for food products.

It is common practice to package articles such as food products in thermoplastic films or laminates to protect the product to be packaged from abuse and exterior contamination and to provide a convenient and durable package for transportation and sale to the end user. Shrink packaging of food products has become extensively used due to its many advantageous properties, e.g., strength, compactness, content security, purge resistance, the attractive appearance of the packed article, etc., which add to the commodity value of the packaged article. Shrink packaging refers to the use of a packaging film manufactured in such a way that when it is exposed to a certain amount of heat, the film will contract in at least one direction along its length or width, preferably in both directions, reducing its overall surface area. When articles are packaged in this type of film, air in the package is usually evacuated and the package is typically passed through a heated shrink tunnel where the package is exposed to an elevated temperature which causes the film to react to the heat and contract around the object. This process results in an attractive skin-tight package. Articles packaged using shrink packaging are numerous and can include food articles, such as frozen pizzas, cheese, poultry, fresh red meat, and processed meat products as well as nonfood industrial articles such as wooden blinds, CD's, etc.

Many food products, such as poultry, fresh red meat, cheeses, and processed meat products, are packaged in individual, pre-manufactured bags of heat-shrinkable film. Typically, individual bags or pouches for packaging food articles include one to three sides heat sealed by the bag manufacturer leaving one side open to allow product insertion and a final seal performed by the food processor. Such individual bags are typically manufactured from shrink films by producing a seamless tube of heat-shrinkable film having a desired diameter, heat sealing one end of a length of the tubular film and cutting off the tube portion containing the sealed portion, thereby forming an individual bag. The bag formed thereby, when it is laid flat, has a bottom edge formed by the heat seal, an open mouth opposite the sealed bottom and two seamless side edges formed by the fold produced when the tube is laid flat. Another method of forming bags from a seamless tube comprises making two spaced-apart transverse seals across the tube and cutting open the side of the tube. If flat sheets of film are used, bags are formed therefrom by heat sealing three edges of two superimposed sheets of film or by end-folding a flat sheet and sealing two sides. U.S. patents describing known heat shrinkable bags include U.S. Pat. Nos. 6,511,688, 5,928,740, and 6,015,235. U.S. patent application Ser. No. 10/371,950, in the name of Thomas Schell et al., filed on Feb. 20, 2003, entitled "HEAT-SHRINKABLE PACKAGING RECEPTACLE", the entirety of which is hereby incorporated by reference hereto, discloses individual heat-shrinkable bags formed from a sheet of film, preferably in a continuous process, wherein opposing side edges of the sheet are sealed longitudinally to form a tube member, which is then sealed and cut transversely to close an end of the tube member thereby forming a backseamed bag.

The known bags for heat-shrink packaging include strong factory and final closing seals to prevent the heat sealed seams from pulling apart during the heat shrinking operation, or during the handling and transport of the packaged article. Although the strong heat seals provide protection against unwanted seal failure, such seals also make it difficult for the end user to open the package. Accordingly, there is needed an improved heat-shrinkable packaging receptacle that includes seals of sufficient seal strength to survive the heat shrinking process and handling and resist spontaneous opening due to residual shrink forces, yet includes at least one heat seal that is readily openable by application of force without requiring use of a knife or cutting implement and without uncontrolled or random tearing or rupturing of the packaging materials, e.g., away from the seal area, which may result in opening in undesired location or in sudden destruction of the package and inadvertent contamination or spillage of the contents of the package.

SUMMARY OF THE INVENTION

The present invention provides an easy opening heat-shrinkable bag adapted to be heat sealed to a closed condition to contain and protect a product disposed therein. At least one heat seal is peelable and readily openable by application of force. The bag is formed from a sheet of film having a first side, an opposing second side, an outer surface and an inner surface. The bag includes a first seal longitudinally joining the first side and the second side, thereby defining a tube member. The tube member, when laid flat, includes a first bag wall, a second bag wall, a first bag edge, an opposing second bag edge, an open mouth and an end. The bag includes a second seal extending laterally across the tube member adjacent the end, thereby sealing the first and second bag walls together and closing the end. A product receiving chamber is defined between the first and second bag walls, the second seal and the open mouth. Preferably, the first seal comprises a lap seal and is at least one peelable heat seal.

BRIEF DESCRIPTION OF THE DRAWINGS

FIG. 1 illustrates a schematic view of a film suitable for making a peelable sealed heat shrink bag according to the present invention.

FIG. 2 illustrates a schematic view of a preferred embodiment of a heat-shrinkable bag according to the present invention, in a substantially lay-flat position.

FIG. 3 illustrates a fragmentary cross-sectional view taken along lines A-A of FIG. 2 depicting an enlarged, not to scale, lap seal area of a preferred film for use in fabricating the bag illustrated in FIGS. 2, 4 and 5.

FIG. 4 illustrates a fragmentary cross-sectional view taken along lines B-B of FIG. 2 depicting an enlarged, not to scale, end seal area of a preferred film.

FIG. 10 illustrates an enlarged fragmentary cross-sectional view of the seal portion of FIG. 9 detailing a preferred film structure.

FIG. 11 illustrates another bag embodiment according to the present invention having a butt-seal backseam.

FIG. 12 illustrates a cross-sectional view of the bag illustrated in FIG. 1, taken through section F-F.

FIG. 13 illustrates another bag according to the present invention having a peel strip.

FIG. 14 illustrates a cross-sectional view of the bag illustrated in FIG. 13, taken along section G-G.

DETAILED DESCRIPTION OF THE INVENTION

Figure 5:
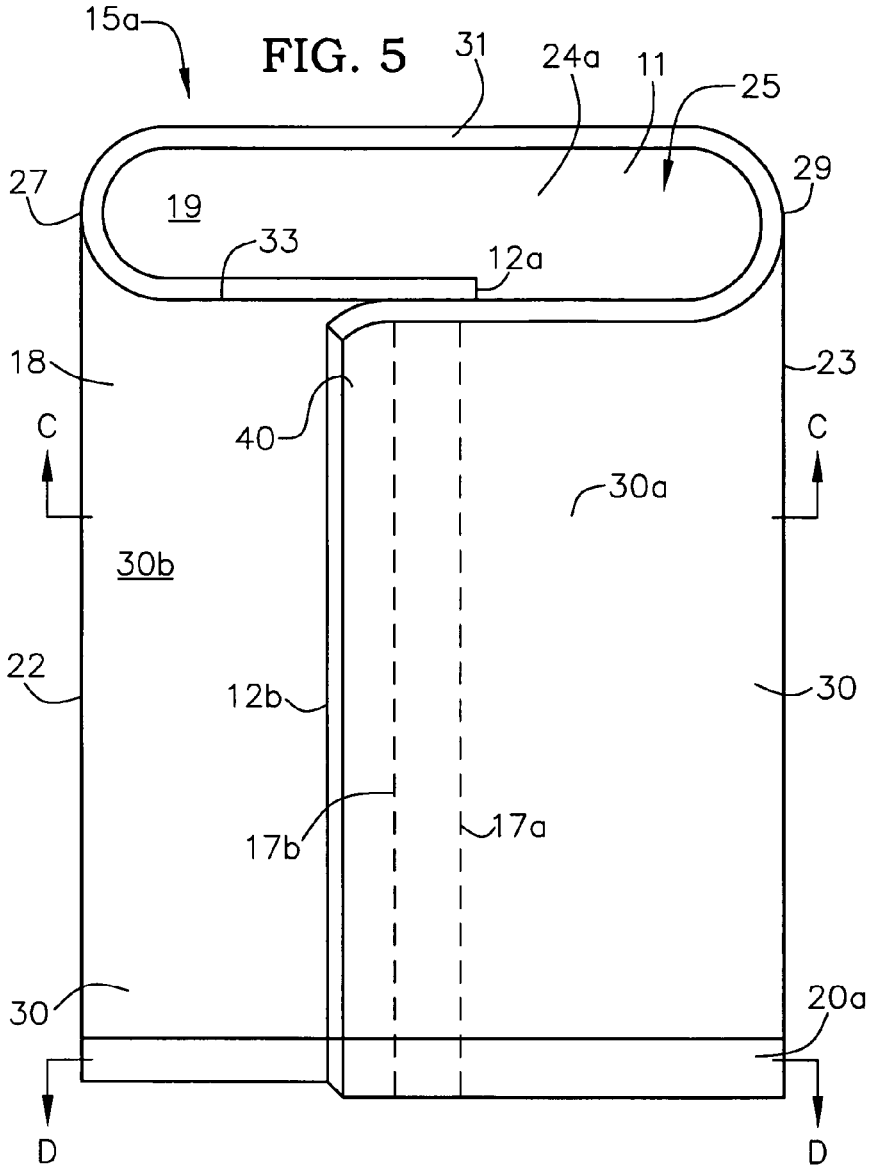
FIG. 5 illustrates schematic view of another preferred embodiment of a heat-shrinkable bag according to the present invention having a pull flap.

A preferred embodiment of the heat-shrinkable package of the present invention is made from a sheet 10 of heat shrinkable film 11 having a first side edge 12*a* and opposing, second side edge 12*b* connected by a third side edge 12*c* and a fourth side edge 12*d*. First side edges 12*a* and second 12*b* are preferably parallel to each other when film 11 is in a long flat planar state. Third side edge 12*c* and fourth side 12*d* are preferably parallel to each other when film 11 is in a lay flat planar state. First and second side edges 12*a*, 12*b* are also preferably perpendicular to third and fourth side edges 12*c*, 12*d* when film 11 is in a lay flat planar state. Film 11 has four corners at the intersections of the four sides with first corner 12*ac* defined by the junction of first side edge 12*a* with third side edge 12*c*; second corner 12*bc* defined by the junction of second side edge 12*b* with third side edge 12*c*; third corner 12*ad* defined by the junction of first side edge 12*a* with fourth side edge 12*d*; and fourth corner 12*bd* defined by the junction of second side edge 12*b* with fourth side edge 12*d*. Film 11 has a top surface 13*a* circumscribed by a perimeter 14 formed by sides 12*a*, 12*c*, 12*b* and 12*d* with an opposing bottom surface 13*b* also circumscribed by said perimeter 14. FIG. 1 depicts corner 12*ad* of film 11 turned upward to reveal said bottom surface 13*b*.

Referring now to FIG. 2, a preferred embodiment of the present invention is depicted generally as a bag 15 made from said film 11 of FIG. 1. The bag 15 is formed by overlapping the first side edge 12*a* with the second side edge 12*b* and sealing preferably by heat to produce a fusion bond lap seal 16 defined by parallel spaced apart dotted lines 17*a* and 17*b*, and third side edge 12*c* and fourth side edge 12*d*. It should be noted that while said lap seal 16 is depicted as a continuous elongated rectangle extending from side 12*c* to side 12*d*, the invention further contemplates that the seal shape may vary and could, for example, form a wavy line or zigzag shape or other shapes as desired. Also, the width of the seal may be varied to be thicker or thinner as desired. Also the seal may optionally be made by alternatives or additional means, including, e.g., by applications of suitable flue or adhesive material known in the art for sealing together films. It is further contemplated that said lap seal 16, while depicted as a continuous lap seal 16 suitable for forming a hermetic package, it is also contemplated that for some applications, e.g., for certain industrial or non-perishable items, a noncontinuous seal having, e.g., the appearance of a dotted or dashed line, may be employed. The intermittent seal embodiment permits air to escape enclosure during packaging operations where it is not desired to either apply a vacuum, or seal with a trapped bubble of air or other gas, or remove air by other means. Optionally, the strength of the seal may be varied by one skilled in the art in view of the teachings of the present application by selection of aforesaid parameters such as seal shape, thickness, continuous or intermittent nature, material selection type of and known parameter for varying the strength of different types of seals, e.g., by adjusting dwell time or temperature for producing heat seals. Such variations and adjustments may be made by those skilled in the art without undue experimentation.

Referring again to FIG. 2, lap seal 16 is preferably a heat seal forming a fusion bond between top surface 13*a* and bottom surface 13*b* of film 11. The overlapped sealed film 11 defines a tube member 18 in which top surface 13*a* of film 11 forms an inner film surface 19 of said tube member 18. A second seal 20 extends laterally across said tube member 18 adjacent the third side edge 12*c* of film 11 thereby forming a closed bag end 21. A variety of seals may be used. Preferably second seal 20 will be a heat seal which fusion bonds the bag film inner surface 19 to itself. The second seal 20 by closing bag end 21 both forms a first bag edge 22 and opposing second bag edge 23, and the second seal extends across the tube member 18 from the first bag edge 22 to the second bag edge 23. The second seal may also employ a variety of shapes, thicknesses, structures, etc., as for the previously described lap seal 16. The lap seal does not need to be centered between edges 22 and 23 but preferably is positioned anywhere therebetween.

Opposite the closed bag end 21 is a bag mouth formed by lap sealed film under fourth side edge 12*d* through which a product (not depicted) may be placed into a product receiving chamber 25 defined by tube member 18, closed bag end 21 and bag mouth 24. The first bag edge 22 may extend from a first bag end corner 26 to a first bag mouth point 27 and a second bag edge 23 may extend from a second bag end corner 28 to a second bag mouth point 29 such that bag 15 may be collapsed into a lay flat condition having first bag edge 22 and opposing second bag edge 23. In a lay flat condition or a state close to lay flat such as depicted in FIG. 2, bag end 21, bag mouth 24 connecting first bag edge 22 and second bag edge 23 define a first bag wall 30 and connected opposing bag wall 31. Tube member 18 has an inner surface 19 and an outer surface 33. The first bag wall 30 has first bag wall first side 30*a* proximate second side edge 12*b* and extending to second bag edge 23. The first bag wall 30 also has an opposing first bag wall seamed side 30*b* proximate first side edge 12*a* and extending to first bag edge 22.

Preferably, the second seal 20 is provided in a manner such that the first seal 16 is positioned within one of the first and second bag walls 30 and 31, thereby forming a "backseam" of the bag. This provides one seamless bag wall and two seamless bag edges that may include printed images applied to the film before forming bags or after the bag is formed. Additionally, the second seal 20 may take any shape, whether straight or curved, so long as the second seal 20 operates to close the end 21. At least one of the first seal 16 and second seal 20 comprises a peelable seal. "Peelable seal" and like terminology are used herein to refer to a seal, and especially heat seals, which are engineered to be readily peelable without uncontrolled or random tearing or rupturing the packaging materials which may result in premature destruction of the package and/or inadvertent contamination or spillage of the contents of the package. A peelable seal is one that can be manually peeled apart to open the package at the seal without resort to a knife or other implement to tear or rupture the package. In the present invention, the peelable seal must have a seal strength sufficient to prevent failure of the seal during the normal heat-shrinking process and further normal handling and transport of the packaged article. The peelable seal strength must also be low enough to permit manual opening of the seal. A peelable seal may have an average peelable seal strength of less than 2 kilograms for a one inch strip or of less than 1.5 kilograms for a one inch strip or of about 500 grams to about 1000 grams for a one inch strip. For example, a peelable first seal may have an average peelable seal strength of less than 2 kilograms for a one inch strip or may have an average peelable seal strength of less than 1.5kilograms for a one inch strip, and a peelable second seal may have an average peelable seal strength of about 500 to about 1000 grams for a one inch strip. Preferably seal parameters such as choice of materials and sealing conditions will be used to adjust the peelable seal strength to the desired level for the particular package and application.

Many varieties of peelable seals are known in the art and are suitable for use with the present invention. Peelable seals are generally made from thermoplastic films having a peelable system designed therein. Suitable peelable films and/or peelable systems are disclosed in U.S. Pat. No. 4,944,409 (Busche et al.); U.S. Pat. No. 4,875,587 (Lulham et al.); U.S. Pat. No. 3,655,503 (Stanley et al.); U.S. Pat. No. 4,058,632 (Evans et al.); U.S. Pat. No. 4,252,846 (Romesberg et al.); U.S. Pat. No. 4,615,926 (Hsu et al.) U.S. Pat. No. 4,666,778 (Hwo); U.S. Pat. No. 4,784,885 (Carespodi); U.S. Pat. No. 4,882,229 (Hwo); U.S. Pat. No. 6,476,137 (Longo); U.S. Pat. No. 5,997,968 (Dries, et al.); U.S. Pat. No. 4,189,519 (Ticknor); U.S. Pat. No. 5,547,752 (Yanidis); U.S. Pat. No. 5,128,414 (Hwo); U.S. Pat. No. 5,023,121 (Pockat, et al.); U.S. Pat. No. 4,937,139 (Genske, et al.); U.S. Pat. No. 4,916,190 (Hwo); and U.S. Pat. No. 4,550,141 (Hoh), the disclosures of which are incorporated herein in their entirety by reference thereto. Preferred films for use in fabricating bags according to the invention may be selected from multilayer, heat-shrinkable films capable of forming a peelable seal. Preferred films may also provide a beneficial combination of one or more or all of the below noted properties including high puncture resistance (e.g., as measured by the ram and/or hot water puncture tests), high shrinkage values, low haze, high gloss, high seal strengths and printability. Since the inventive bags may advantageously be used to hold oxygen or moisture sensitive articles such as food products after evacuation and sealing, it is preferred to use a thermoplastic film which includes an oxygen and/or moisture barrier layer. The terms "barrier" or "barrier layer" as used herein means a layer of a multilayer film which acts as a physical barrier to moisture or oxygen molecules. Advantageous for packaging of oxygen sensitive materials such as fresh red meat, a barrier layer material in conjunction with the other film layers will provide an oxygen gas transmission rate ($O_2$GTR) of less than 70 (preferably 45 or less, more preferably 15 or less) cc per square meter in 24 hours at one atmosphere at a temperature of 73° F. (23° C.) and 0% relative humidity. In an alternative embodiment, the gas permeability is controlled to allow the escape of $CO_2$, e.g., for packaging respiring foods such as cheese as described in U.S. Pat. No. 6,511,688. Preferably, the film has an unrestrained shrinkage of at least 20% (preferably at least 35%) at 90° C. at least one and preferably both the machine (MD) and transverse (TD) directions. Unrestrained (sometimes referred to as "free") shrink is measured by cutting a square piece of film measuring 10 cm in each of the machine and transverse directions. The film is immersed in water at 90° C. for five seconds. After removal from the water the piece is measured and the difference from the original dimensions are each multiplied by ten to obtain the percentage of shrink in each respective direction.

Oxygen barrier materials which may be included in the films utilized for the inventive bags include ethylene vinyl alcohol copolymers (EVOH), polyacrylonitriles, polyamides and vinylidene chloride copolymers (PVDC). For some applications nylon may provide useful oxygen barrier properties especially at low temperatures, e.g., as used with frozen foods. Preferred oxygen barrier polymers for use with the present invention are vinylidene chloride copolymers or vinylidene chloride with various comonomers such as vinyl chloride (VC-VDC copolymer) or methyl acrylate (MA-VDC copolymer), as well as EVOH. A specifically preferred barrier layer comprises about 85% vinylidene chloride-methyl acrylate comonomer and about 15% vinylidene chloride-vinyl chloride comonomer, as for example described in Schuetz et al. U.S. Pat. No. 4,798,751. Suitable and preferred EVOH copolymers are described in U.S. Pat. No. 5,759,648. The teachings of both the '751 and '648 patents are hereby incorporated by reference in their entireties.

A variety of peelable films and peelable sealing systems may be employed in the present invention. In a preferred embodiment, a film comprising a coextrusion of at least three layers (referred to as three layer peelable system to distinguish it from systems using one or more contaminated seal layers described below) having an outer layer, an inner heat seal layer and a tie layer disposed between the outer layer and the inner heat seal layer is used. In this preferred three layer system embodiment, the film layers are selected such that peeling occurs by breaking apart the tie layer and/or a bond between the tie layer and at least one of the outer and inner layers. Permanent, peelable, and fracturable bonds may be engineered into the coextrusion process, e.g., by providing two adjacent first and second layers having materials with a greater affinity for each other compared to the second layer and an adjacent third layer where this establishes a relatively permanent bond between the layers, when two materials have a lesser affinity for each other. This three layer structure establishes a relatively permanent bond between the first and second layer which have a greater affinity for one another than the second or third layers which have a lesser affinity where the second layer is common to both the first and third layers as a tie layer or connecting layer. Thus, the lesser affinity between the second and third layers relative to the first and second layers produces a relatively peelable bond between the second and third layers. Selection of the various materials determines the nature of the bond, i.e., whether it is permanent, peelable, fracturable or combinations thereof.

Suitable polymers for use in the outer, tie and inner heat sealable layers include both poly-type material such as ethylene homopolymers and copolymers as well as ionomer type material. Examples of suitable polymers include: ethylene vinyl acetate copolymer (EVA, ethylene α-olefin copolymers, linear low density polyethylene, low density polyethylene, very low density polyethylene (VLDPE), neutralized ethylene acid copolymer, plastomers, ethylene acrylate copolymer, ethylene methyl acrylate copolymer and zinc or sodium salts of partially or completely neutralized ethylene-methacrylate acid copolymers. The inner heat seal layer beneficially uses heat sealable materials. The tie layer is selected to have a relatively low peel strength when peelably bonded to one of either the outer layer or inner heat seal layer. The tie layer is typically comprised of a blend of about 5-30% polybutylene and another constituent, such as ethylene vinyl acetate copolymer, ethylene copolymers with $C_4$-$C_8$ alpha olefin, linear low density polyethylene, ionomers, neutralized ethylene acid copolymer or unneutralized ethylene acid copolymer and mixtures thereof. The term "polybutylene" as used herein includes having polymeric units derived from butene-1 as the major (75% polymeric units) components and preferably at least 80% of its polymeric units will be derived from butene-1. A preferred polybutylene is a random copolymer of butene-1 with ethylene having a reported density of 0.908 g/cm$^3$ and a melt index of 1.0 g/10 min. and a melting point of 243° F., which is commercially available from Basell Polyolefins Company, N.V., The Netherlands, under the trade name PB 8640. In this preferred peelable embodiment, the heat seal formed between the inner heat seal layer and another layer to which it is heat sealed, whether part of another film or the same, should be permanent, i.e., should have a seal strength greater than the peelable bond between the tie layer and one of its adjacent layers. The preferred three layer coextruded peeling structure described above contemplates optional additional layers to product a film of 4, 5, 6, 7, 8, 9, 10 or more layers. It is further contemplated that one or more additional layers may be coextruded with the described three layers or separately and that the multilayer film structure may be formed not only by coextrusion, but also by other methods well known in the art such as coating lamination, adhesive lamination or combinations thereof.

It is also contemplated that such one or more additional layers may be adjacent to or between any of the described three layers. In one embodiment of the invention the heat seal layer may be replaced by a permanent adhesive or glue that may or may not be applied hot or in a melt state, liquid state or otherwise. However, it is preferred to utilize a heat sealable layer.

It is also contemplated that a peelable seal using one or more so-called "contaminated" surface layers may be utilized where peeling occurs at a seal layer interface 32 rather than at an interior layer of film 11. This type of peeling system suffers from disadvantage associate with, e.g., controlling the diverging properties of providing high seal strength with desirable low forms for peelings, as well as problems of sealing under conditions which may adversely affect seal integrity, e.g., where an article being packaged deposits particulates, starch, fat, grease or other components which may lessen seal strength or hamper the ability to provide a seal of desired strength such as a strong hermetic fusion bond, e.g., by heat sealing. Such sealing systems are often referred to as two layer peeling systems, but may include 3, 4, 5, 6, 7, 8, 9, 10 or more layers in the film structure.

Preferred peelable sealing films and peelable seal systems are disclosed in U.S. Pat. No. 4,944,409 entitled "EASY OPEN PACKAGE", the disclosure of which is incorporated herein in its entirety.

A preferred multilayer, barrier film structure for use in fabricating bags according to the present invention is illustrated in FIG. 3, which depicts an enlarged, end view of the first seal 16 of FIG. 2 made from the sheet of heat-shrinkable film 11. Layer thicknesses in FIG. 3 and other figures presented herein are not to scale, but are dimensioned for ease of illustration. A preferred easy to peel heat shrinkable film 11 is a five layer coextrusion and includes from inner surface 19 of the tube member 19 (See FIG. 2) to an opposing outer surface 33.

(a) an inner surface heat sealing layer 34 preferably comprising a blend of ethylene vinyl acetate (EVA) and polyethylene;

(b) a barrier layer 35 preferably comprising a vinylidene chloride copolymer (PVDC);

(c) a core layer 36 preferably comprising a blend of EVA and polyethylene;

(d) a tie layer 37 preferably comprising a blend of polyethylene and polybutylene; and, (e) an outer surface heat sealing layer 38 preferably comprising polyethylene.

The thicknesses of each layer, based on the total thickness of the film 11, may be typically <50% inner surface heat sealing layer 34; <20% barrier layer 35; <28% core layer 36; <15% tie layer 37; and <15% outer heat sealing layer 38. The first seal 16 is made by longitudinally heat sealing the inner film surface 19 of film 11 to the outer film surface 33 along their respective lengths, such that inner film surface 19 and outer film surface 33 overlap. In this manner, a fusion bond is made between the inner surface heat sealing layer 34 and the outer surface heat sealing layer 38. The peelable bond of the system is provided by the tie layer 37 and peeling occurs there, e.g., at the tie layer interface with the outer surface heat sealing layer 38, and/or at the tie layer interface with core layer 36 and/or between outer layer 38 and core layer 36. Thus, referring to FIGS. 2 and 3, the peelable portion of the film is on the outside of the tube member 18, which is preferable. This will insure that the first seal 16 is peelable, while the second seal 20 and final closing seal (not shown) are strong fusion seals between the inner surface heat sealing layer 34 of each bag wall 30 and 31.

Referring to FIG. 4, a fragmentary sectional view taken along lines B-B of FIG. 2 illustrates how a preferred embodiment of the invention works to create strong end seals while permitting the lap seal to function as an easy to open peel seal. In FIG. 4, film 11 has an outer surface 33 with consecutive layers therefrom of outer surface layer 38, tie layer 37, core layer 36, barrier layer 35, and inner surface heat sealing layer 34. Referring to FIG. 2, the second seal 20 is provided across tube member 18 to collapse its surface 19 upon itself. Referring again to FIG. 4, this seal joins inner surface heat sealing layer 34 to itself with the peelable tie layer 37 being positioned distal from end seal interface 39. This preferred embodiment of the invention depicted in FIGS. 2-4 combines (a) an end seal which mates like materials with strong seal properties to each other keeping distal the easily peelable tie layer 37 and (b) a lap seal having peelable tie layer 37 proximate the outer surface heat sealing layer 38 and lap seal interface 32, thereby providing an easily peelable opening in bags or packages made using the described configuration.

The film 11 is designed to control the film failure when peeled manually. Due to the composition of the peelable tie layer 37, its location proximate the lap seal interface 32, and in the case of the preferred three layer peelable system, the thinness and composition of the outer surface heat sealing layer 38; as the second side edge **12*b* is manually pulled across, up and away from the lap seal 16, a first rupture or tear will begin. This tear will propagate from the heat seal at the edge 17*b* of lap seal interface 32 through the outer heat sealing layer 38 thereof. If the peelable bond is designed to occur at the tie layer 37, the continued application of opening force causes: a delamination or breaking of the adhesive bond, along the tie layer 37/outer heat sealing layer 38 interface or along the tie layer 37/core layer 36 interface and/or causes fracture of the tie layer 37, or a combination thereof until the tear reaches the opposite side edge 17*a* of the heat seal 16, where the tear either propagates to edge 12*a* or back across the outer layer 38** and the bag is thereby opened.

In general, the films used in the heat-shrinkable bags of the present invention can have any thickness desired, so long as the films have sufficient thickness and composition to provide the desired properties for the particular packaging operation in which the film is used, e.g., peelable seal, puncture-resistance, modulus, seal strength, barrier, optics, etc. For efficiency and conservation of materials, it is desirable to provide the necessary puncture-resistance and other properties using the minimum film thicknesses. Preferably, the film has a total thickness from about 1.25 to about 8.0 mils; more preferably from about 1.75 to about 3.0 mils.

Figure 6:
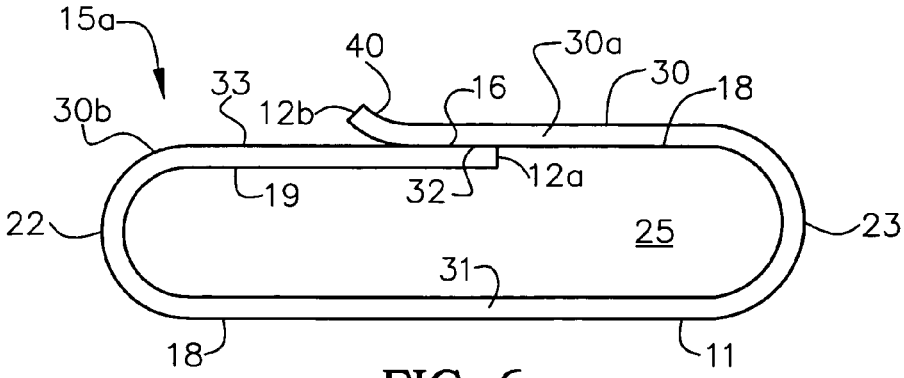
FIG. 6 illustrates a transverse cross-sectional view of the bag illustrated in FIG. 5, taken through section C-C of FIG. 5.

Another embodiment of the present invention is illustrated in FIGS. 5 and 6, generally as bag 15*a*. Identical reference numerals have been used with respect to elements of Bag 15*a*, which are also found in bag 15. Bag 15*a* further includes a pull flap 40. The pull flap 40 is formed by providing additional overlap by moving the first and second sides edge 12*a* and 12*b* further apart and positioning the first lap seal 16 such that a portion of the first bag wall, first side 30*a*, that overlaps the first bag wall second side 30*b* outside of the product receiving chamber 25 is not sealed to the second side 30*b*. The pull flap 40 may be readily grasped by the end user and pulled to easily open the package, without resort to a cutting instrument, as is often required when opening packages without a peelable system. Although shown as extending the entire length of the bag 15*a*, a skilled artisan will appreciate that the pull flap 40 may be cut to a desired shape or that any other known device known to aid initiation of peeling may be incorporated. The preferred film illustrated in FIGS. 1, 3 AND 4 described previously is also preferred for use with bag 15*a*.

The alternative embodiment illustrated in FIGS. 5 and 6 has reversed the location of the bag mouth 24 and second seal 20 of FIG. 1 which is depicted in FIG. 5 as bag mouth 24*a* and second seal 20*a*.

Figure 7:
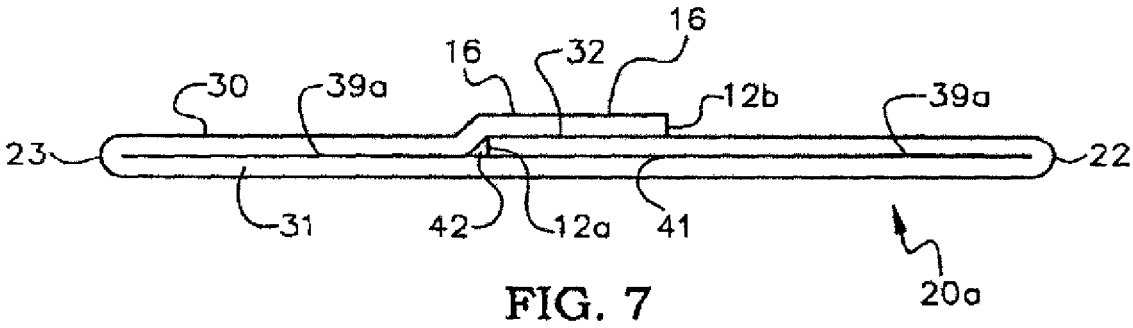
FIG. 7 illustrates a cross-sectional view taken along lines D-D of FIG. 6, depicting an end seal.

Referring to FIG. 7, an illustration of the second seal 20*a* in cross-section shows first bag wall 30 sealed to second bag wall 31 from first bag edge 22 to second bag edge 23 and across first lap seal 16 which is located between first side edge 12*a* and second side edge 12*b*. In the well known heat sealing process opposing sealing bars or wires press together layers of film under elevated temperature and pressure for a time sufficient to cause a fusion bond therebetween. These heat seal bars may be rigid and/or flexible but generally are not supple or not as supple as the film being sealed. As depicted in FIG. 7, the second seal 20*a* has a seal interface 39*a* which has two possible points proximate first side edge 12*a* and second side edge 12*b* where sealing pressure may be reduced during the sealing operation sealing pressure may be reduced at second seal interface 39*a* at a point 41 below edge 12*b*, and also at point 42 adjacent first edge 12*a*. It is also possible that a void may exist, e.g., at point 42. In order to produce a desired strong seal particularly at points 41 and 42 as well as all along second seal interface 39*a*, sealing parameters such as pressure, temperature, dwell time and heat sealing layer composition may be adjusted as desired. In particular, it has been found that use of a high melt index polymer component in the heat seal layer may be advantageous to fill potential voids. It may also be advantageous to taper one or both edges 12*a* and 12*b* to increase contact surfaces and/or pressure between the overlapping films particularly at points 41 and 42 and adjacent areas.

Figure 8:
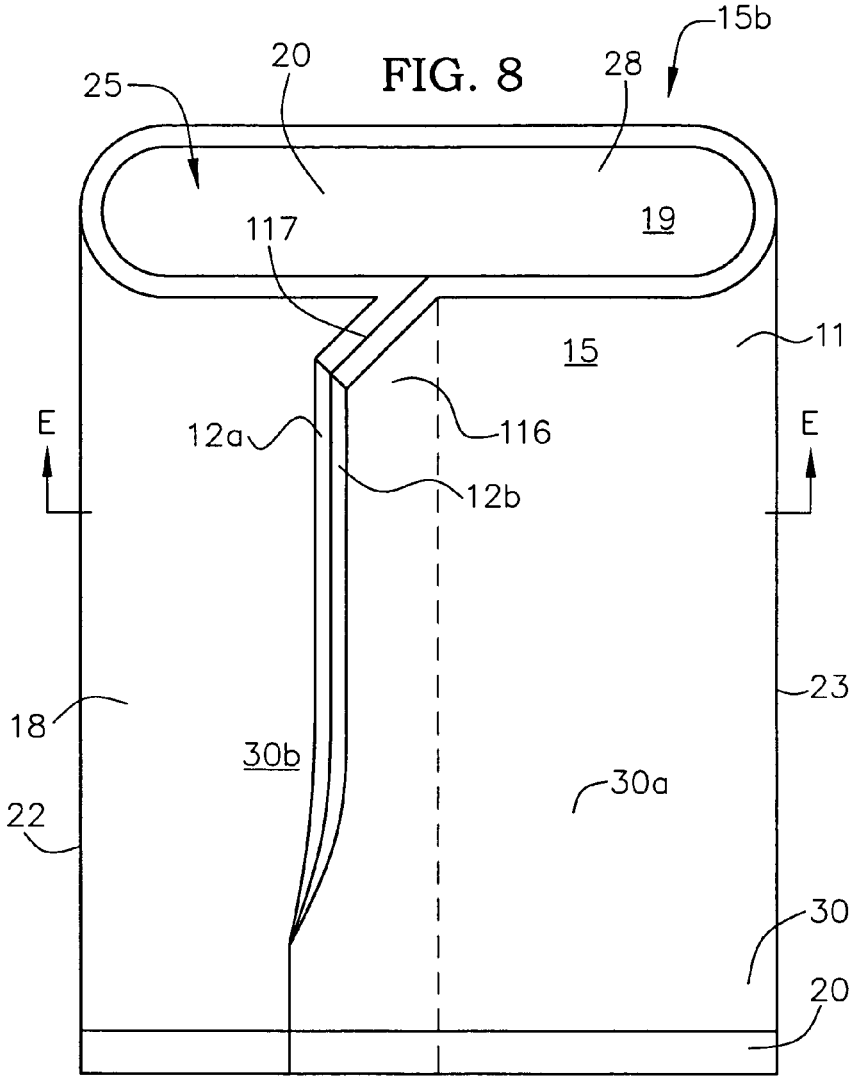
FIG. 8 illustrates yet another bag according to the present invention having a fin seal backseam.
Figure 9:
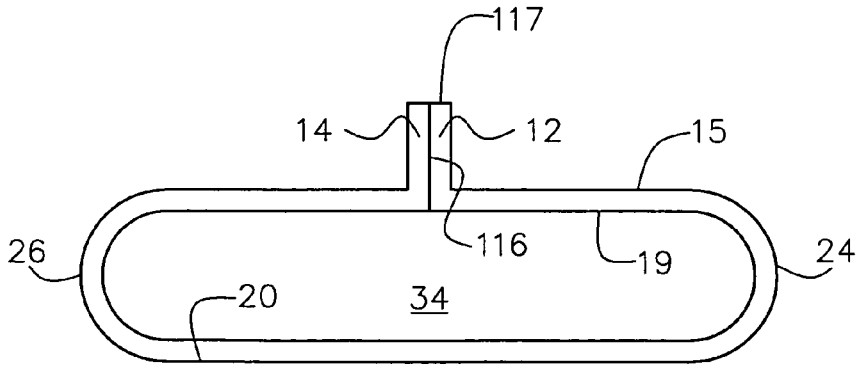
FIG. 9 illustrates a cross-sectional view of the bag illustrated in FIG. 8, taken through section E-E.

Another embodiment of the present invention is illustrated in FIG. 8, generally as bag 15*b*. Again, like elements include like reference numerals. Bag 15*b* includes a first fin seal 116 joining the first and second sides 30*a* and 30*b* of bag wall 30 such that the inner film surfaces 19 of each side are in a face-to-face abutment, having a fin seal interface 117. One or both of the first and second side edges 12*a* and 12*b* may extend outwardly beyond the first fin seal interface 117 such that a pull flap (not shown) is provided. Bag 15*a* (FIG. 5) is preferred over bag 15*b*, since the plane of the first seal 16 is parallel to the plane of the shrink forces encountered during the heat-shrinking process. The first fin seal 116 of bag 15*b* places the plane of the heat seal perpendicular to the shrink forces (as shown by arrows Z' and Z" in FIG. 10), which increases the risk of seal failure (premature peeling) during the heat-shrinking process. Additionally, since the inventive receptacles are advantageously fabricated from a single sheet or web of film, then a fin seal arrangement, such as first seal 116, requires that each seal of the receptacle be a peelable seal. Also, the second seal 20 and final closing seal (not shown) are also necessarily peelable since the first and second bag walls 30*a* and 30*b* are sealed with the film in the same abutted relationship. For example, FIG. 10 depicts an enlarged view of the first fin seal 116 shown in cross-section showing discrete layers of the preferred film discussed above with bags 15 and 15*a*. Each wall 50 and 52 of the seal 116 includes a three layer peelable system (the tie layer 37) equidistant from and proximate to the sealed interface of sealant layer 38. Thus, it not only cannot be predetermined in which wall 50 or 52 the peel failure will occur, but all seals are easily peeled and the shrink force direction further reduces the ability to make strong seals. For all these disadvantages this embodiment is least favored.

Another embodiment of the present invention is illustrated in FIGS. 11 and 12 generally as bag 15*c*. Again, like elements include like reference numerals. Bag 15*c* includes a first seal 216 comprising a butt-seal tape 241 comprising a butt-seal film 211 having a first border 207, a second border 209, a sealing surface 215 and an exterior surface 214. The first seal 216 includes a first heat seal 218 longitudinally joining the first side 30*a* of bag wall 30 to the first border 207 of the butt-seal tape 241, and a second heat seal 219 longitudinally joining the second side 30*b* of bag wall 30 to the second border 209 of the butt-seal tape 241. Thus, first and second sides 30*a* and 30*b* are joined in an abutting edge-to-edge relationship thereby forming bag wall 30 without a heat seal directly there between. Preferably, the butt-seal film 211 comprises the same film as described in reference to bags 15, 15*a* and 15*b* described above and illustrated in FIGS. 1-10, with the outer heat sealing layer 38 (FIG. 2) comprising the inner surface 215. Thus, bag 15*c* may be manufactured from a film that does not include a peelable system therein, but includes a peelable seal by means of the peelable system included in the butt-seal tape 241 used to form the first seal 216. Conversely, the film 11 may preferably include a peelable system while the butt-seal tape 241 does not, or both film 11 and butt-seal film 211 may include a peelable system compatible with the other. The butt-seal film 211 is preferably heat-shrinkable, but need not be. A pull flap 40 may be provided in the butt-seal tape 241 to provide an area for the consumer to manually grasp and pull to easily open the bag 15*c*. If the butt-seal tape 241 is sealed to the inner surface 19 of the film 11, then a portion of the first or second sides 30*a* and 30*b* may extend outwardly past the first or second heat seals 218 and 219 to provide a pull flap for the consumer to grasp. The second seal 20 is preferably a permanent seal made between the inner surfaces 19 of the first and second bag walls 30*a* and 30*b*.

Although depicted in FIG. 11 as being sealed to the outer surfaces 15 of the first and second sides 12 and 14, one skilled in the art will appreciate that the butt-seal tape 241 that forms the first seal 216 may be placed on the inside of the bag 10*c* (not shown), whereby the sealing surface 215 is heat sealed to inner surfaces 19 of the first and second sides 30*a* and 30*b*. In this instance, preferably at least one of the first and second sides 30*a* and 30*b* include a portion that extends outwardly beyond the heat seal to the butt-seal tape 241. Thus, the consumer is provided with a pull flap to grasp.

A further embodiment of the present invention is illustrated in FIGS. 13 and 14 generally as bag 15*d*. Like elements discussed above in connection with bags 15, 15*a*, 15*b* and 15*c* have been given the same reference numerals in bag 15*d*. Bag 15*d* includes a first seal 316 comprising a seal strip 341 comprising a strip film 311 having an inside surface 314 and an outward surface 315. The seal strip 341 includes a first margin 318 longitudinally heat sealed to the first side 30*a* by first heat seal 320, such that the outward surface 315 is sealed in face-to-face contact with the inner surface 19 of film 11. The seal strip 341 includes a second margin 319 longitudinally heat sealed to the second side 30*b* by second heat seal 321, such that the inside surface 314 is sealed in face-to-face contact with the outer surface 33 of the second side 30*b*. A pull flap 40 may be provided by including a portion of the strip film 311 that extends outwardly beyond second heat seal 321 joining the second margin 319 and the second side 30*b*. Alternatively, the first side 30*a* could be provided with a portion that extends outwardly beyond the second heat seal 20.

Preferably, the strip film 311 includes a peelable system and comprises the same film as described in reference to bags 15, 15*a* and 15*b* described above and illustrated in FIGS. 1-12, with the outer heat sealing layer 38 (FIGS. 3-4) comprising the inside surface 314. In this manner, the heat seal 321 is peelable and the film 11 need not include a peelable system. Alternatively, the outer heat sealing layer 38 could comprise the outward surface 315, such that heat seal 320 is peelable. In this case, the film 11 need not include a peelable system and the second seal 20 may be made permanent. In a similar manner as described for bag 15*c*, the strip film 311 may not include a peelable system while the film 11 does include a peelable system, or both film 11 and strip film 311 may include compatible peelable systems. The strip film 311 is preferably heat-shrinkable, but need not be.

The bags according to the invention are preferably fabricated continuously from a continuous sheet or roll stock as described in U.S. patent application Ser. No. 10/371,950, in the name of Gregory Robert Pockat, et al., filed on Feb. 20, 2003 entitled "HEAT-SHRINKABLE PACKAGING RECEPTACLE". The roll stock is slit to a desired width and fed to bag making equipment, wherein the machine direction sides of the film are brought together and sealed longitudinally, either with a lap seal (bags 15 and 15*a*) or a fin seal (bag 15*b*) to form a continuous single-seamed tube, or tube member. A transverse seal is made across the tube member and the section including the transverse seal is severed from the continuous tube to form the individual bag. Generally, heat seals are made by supplying sufficient heat and pressure between to polymeric film layer surfaces for a sufficient amount of time to cause a fusion bond between the polymeric film layers. Common methods of forming heat seals include hot bar sealing, wherein adjacent polymeric layers are held in face-to-face contact by opposing bars of which at least one is heated, and impulse sealing, wherein adjacent polymeric layers are held in face-to-face contact by opposing bars of which at least one includes a wire or ribbon through which electric current is passed for a very brief period of time to cause sufficient heat to cause the film layers to fusion bond. Less area is generally bonded with an impulse seal relative to a hot bar seal, thus the performance of the film's sealing layer is more critical. However, an impulse seal is generally more aesthetic since less area is used to form the bond.

The films selected to fabricate the inventive receptacles are preferably biaxially stretched or oriented by the well-known trapped bubble or double bubble technique as for example described in U.S. Pat. Nos. 3,456,044 and 6,511,688 whose descriptions and teachings are hereby incorporated by reference in their entireties. In this technique an extruded primary tube leaving the tubular extrusion die is cooled, collapsed and then preferably oriented by reheating, reinflating to form a secondary bubble and recooling. The film is preferably biaxially oriented wherein transverse (TD) orientation is accomplished by inflation to radially expand the heated film. Machine direction (MD) orientation is preferably accomplished with the use of nip rolls rotating at different speeds to pull or draw the film tube in the machine direction. The stretch ratio in the biaxial orientation to form the bag material is preferably sufficient to provide a film with total thickness of between about 1 and 8 mils. The MD stretch ratio is typically 3:1-5:1 and the TD stretch ratio is also typically 3:1-5:1.

Figure 15:
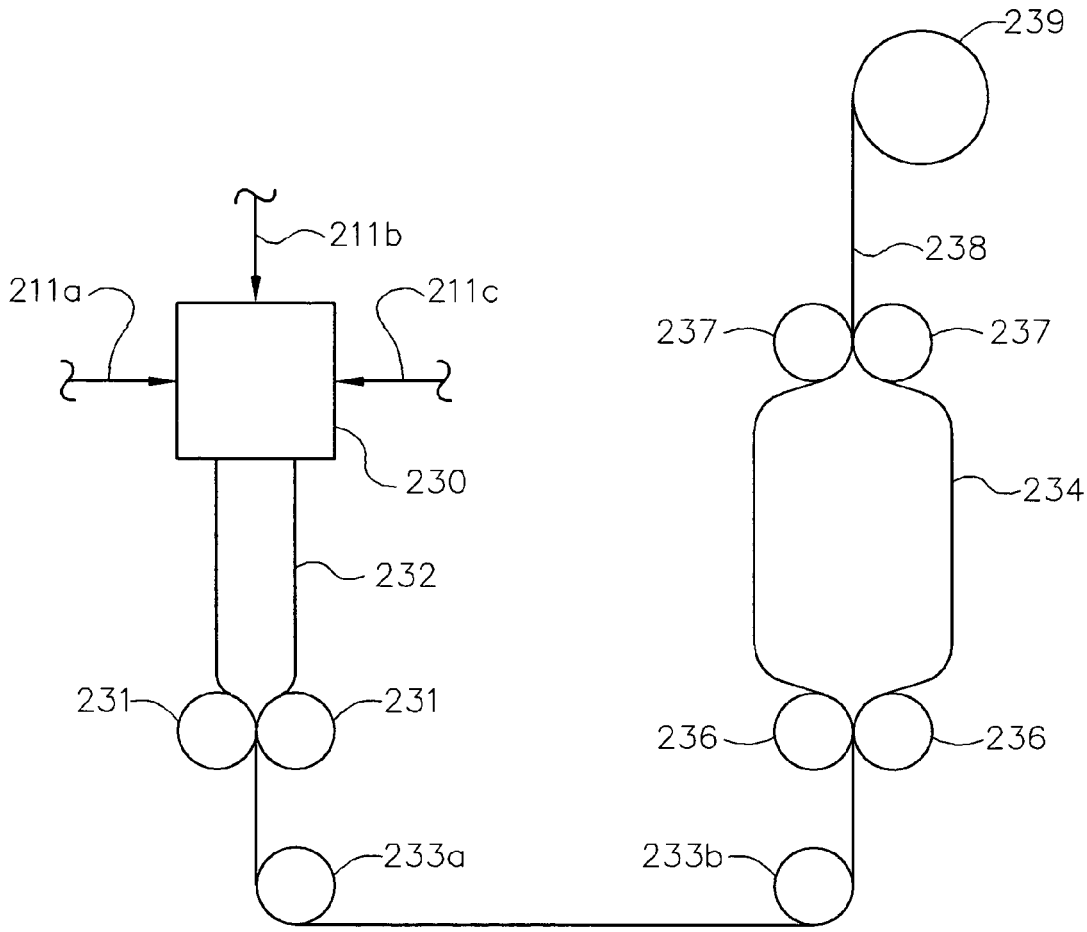
FIG. 15 is a schematic illustration of a preferred method of manufacturing films for use with the present invention.

Referring now to FIG. 15, a double bubble (also known as a trapped bubble) process is shown. The polymer blends making up the several layers are coextruded by conveying separate melt streams 211*a*, 211*b*, and 211*c* to the die 230. These polymer melts are joined together and coextruded from annular die 230 as a relatively thick walled multilayered tube 232. The thick walled primary tube 232 leaving the extrusion die is cooled and collapsed by nip rollers 231 and the collapsed primary tube 232 is conveyed by transport rollers 233*a* and 233*b* to a reheating zone where tube 232 is then reheated to below the melting point of the layers being oriented and inflated with a trapped fluid, preferably gas, most preferably air, to form a secondary bubble 234 and cooled. The secondary bubble 234 is formed by a fluid trapped between a first pair of nip rollers 236 at one end of the bubble and a second pair of nip rollers 237 at the opposing end of the bubble. The inflation which radially expands the film provides transverse direction (TD) stretching and orientation. Orientation in the machine direction (MD) is accomplished by adjusting the relative speed and/or size of nip rollers 236 and nip rollers 237 to stretch (draw) the film in the machine direction.

The biaxial orientation preferably is sufficient to provide a multilayer film with a total thickness less than 10 mil and typically from about 1.25 to 8.0 mils or more, preferably less than 5 mil and more preferably between 1.75 and 3.0 mils (44.5 to 76μ).

After orientation, the tubular film 238 is collapsed preferably to a flatwidth of up to 80 inches, typically between about 5-30 inches, slit open longitudinally, laid flat and wound on a reel 239 for use as rollstock. One skilled in the art will appreciate that while the above described method may be used to form the film, films may be made by other conventional processes, including single bubble blown film or slot cast sheet extrusion processes with subsequent stretching, e.g., by tentering to provide orientation. One skilled in the art will further appreciate that the flatwidth of the collapsed tube will determine the width of the sheet film that results therefrom. Thus, the primary tube dimensions and subsequent processing may be selected to provide a maximum flatwidth and film thickness for the desired application, thereby advantageously maximizing the production capacity of the film making equipment.

Advantageously, a bag maker may produce bags of various lengths and widths from rolls of film rollstock by adjusting the width of the sheet and the distances between the transverse end seal and bag mouth for a particular bag or series of bags. This advantageously avoids the costly need to produce specific widths of seamless tubes which are currently widely used by meat packers and which do not include a peelable seal. Also the present invention permits cost savings and manufacturing efficiencies by permitting creation of numerous widths and lengths of bag from standard rollstock. The bag maker may simply slit film rollstock to a desired width and form a continuous tube member by longitudinally sealing opposing sides as described for bags 15, 15*a* and 15*b*. Bags of adjustable lengths may be made by transversely sealing and cutting through the tube member at a position spaced from the transverse seal.

Figure 16:
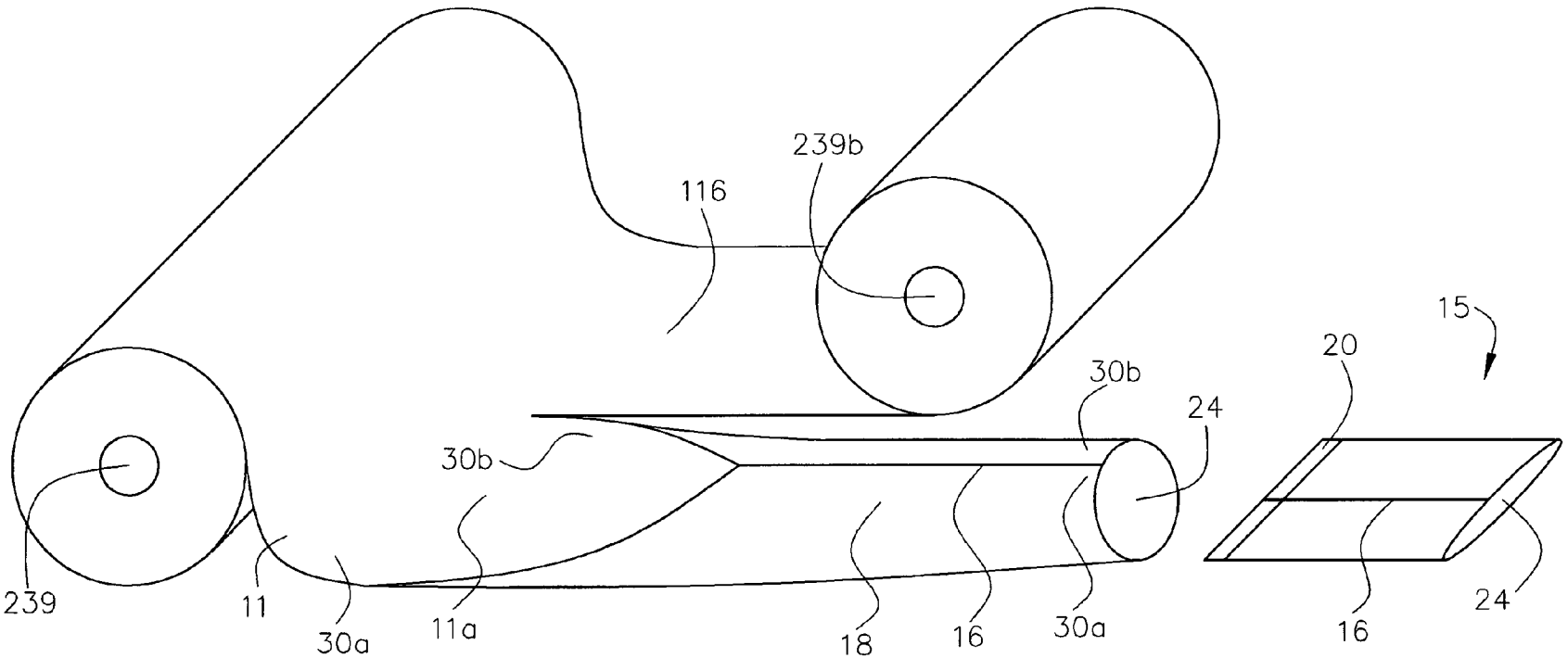
FIG. 16 is a schematic illustration of a preferred method of manufacturing bags according to the present invention.

Preferably, bag making is a continuous process; shown schematically in FIG. 16, wherein the film is directed to a bag making assembly (not shown) where individual end-seal bags are made. Film 11 is fed continuously from reel 239 and optionally slit to form a desired width film 11*a* and an unused film 11*b*. Film 11*a* is fed to a bag making assembly (not shown). Unused film 11*b* is rewound on reel 239*b* for later use, or may be fed to another bag making assembly. The first and second sides 30*a* and 30*b* of film 11*a* are brought together and sealed longitudinally, preferably in a first seal, e.g., lap seal 16 having an additional overlap portion that will act as a pull flap, to form a continuous backseamed tube member 18. The second seal 20 is provided transversely across the tube member 18 at a desired location spaced from the opening 24. The tube member 18 is then (or preferably simultaneously) severed to separate the portion containing the second seal from the continuous tube, thereby forming bag 15. Typically as the transverse seal is made for one bag a transverse cut forming the mouth of the adjacent bag is being made. This process forms a so called "end-seal" bag which, when it is laid flat, has a bottom edge formed by the transverse heat seal, an open mouth formed by the severed edge and two side edges formed by the fold produced when the tube member is laid flat. The transverse heat seal should extend across the entire tube member to ensure a hermetic closure where such is desired. Each bag being formed from a length of the tube member will necessarily be formed by at least two, usually parallel, spaced apart, transverse cuts which cause a segment of the tube member to be made and one transverse seal, usually adjacent one of these cuts, will define a bag bottom which is located opposing the bag opening, which is formed by the distal cut. The spacing between the lateral seal and the opening, which may vary, will determine the length of the bags formed. The length of the bags can easily be varied by changing the distance between transverse seals and cuts. The width of the bags can also be easily varied by changing the width of the film by slitting the standard rollstock.

Unless otherwise noted, the following physical properties are used to describe the invention, films and seals. These properties are measured by either the test procedures described below or tests similar to the following methods.

Average Gauge: ASTM D-2103

Tensile Strength: ASTM D-882, method A

1% Secant Modulus: ASTM D-882, method A

Oxygen Gas Transmission Rate ($O_2$GTR): ASTM D-3985-81

Percent Elongation at Break: ASTM D-882, method A

Molecular Weight Distribution: Gel permeation chromatography

Gloss: ASTM D-2457, 45° Angle

Haze: ASTM D-1003-52

Melt Index: ASTM D-1238, Condition E (190° C.) (except for propene-based (>50% $C_3$ content) polymers tested at Condition L (230° C.))

Melting Point: ASTM D-3418, peak m.p. determined by DSC with a 10° C./min. heating rate.

Vicat Softening Point (Vsp): ASTM D-1525-82

Seal Strength: ASTM F88-94 (Standard Test Methods for Seal Strength of Flexible Barrier Materials)

All ASTM test methods noted herein are incorporated by reference into this disclosure.

Shrinkage Values: Shrinkage values are obtained by measuring unrestrained shrink of a 10 cm. square sample immersed in water at 90° C. (or the indicated temperature if different) for five to ten seconds. Four test specimens are cut from a given sample of the film to be tested. Specimens are cut into squares of 10 cm length (M.D.) by 10 cm. length (T.D.). Each specimen is completely immersed for 5-10 seconds in a 90° C. (or the indicated temperature if different) water bath. The specimen is then removed from the bath and the distance between the ends of the shrunken specimen is measured for both the M.D. and T.D. directions. The difference in the measured distance for the shrunken specimen and each original 10 cm. side is multiplied by ten to obtain percent shrinkage in each direction. The shrinkage of 4 specimens is averaged and the average M.D. and T.D. shrinkage values reported. The term "heat shrinkable film at 90° C." means a film having an unrestrained shrinkage value of at least 10% in at least one direction.

Tensile Seal Strength (Seal Strength) Test

Five identical samples of film are cut 1 inch (2.54 cm) wide and a suitable length for the test equipment e.g. about 5 inches (12.7 cm) long with a 1 inch (2.54 cm) wide seal portion centrally and transversely disposed. Opposing end portions of a film sample are secured in opposing clamps in a universal tensile testing instrument. The film is secured in a taut snug fit between the clamps without stretching prior to beginning the test. The test is conducted at an ambient or room temperature (RT) (about 23° C.) test temperature. The instrument is activated to pull the film via the clamps transverse to the seal at a uniform rate of 12.0 inches (30.48 cm) per minute until failure of the film (breakage of film or seal, or delamination and loss of film integrity). The test temperature noted and lbs. force at break are measured and recorded. The test is repeated for four additional samples and the average grams at break reported. A peelable seal strength may be determined by the same test except that one clamp is set to secure the film at its end adjacent the seal so that when the instrument is activated the film is pulled along the seal interface to simulate peeling open the seal. For a fin seal, both seal strength determinations are the same, as the forces are applied in the same direction relative to the seal for a seal strength determination as for a peelable seal strength determination. For a lap seal, the forces are applied in different directions, and the peelable seal strength may differ from the seal strength.

Ram Puncture Test

The ram puncture test is used to determine the maximum puncture load or force, and the maximum puncture stress of a flexible film when struck by a hemispherically or spherically shaped striker. This test provides a quantitative measure of the puncture resistance of thin plastic films. This test is further described in U.S. patent application Ser. No. 09/401,692 and the teachings of the '692 patent application are hereby incorporated by reference in their entirety.

Following are examples and comparative examples given to illustrate the invention.

In all the following examples, unless otherwise indicated, the film compositions were produced generally utilizing the apparatus and method described in U.S. Pat. No. 3,456,044 (Pahlke) and U.S. Pat. No. 6,511,688 (Edwards, et al.) which both describe a coextrusion type of double bubble method and in further accordance with the detailed description above. In the following examples, all layers are extruded (coextruded in the multilayer examples) as a primary tube which is then cooled upon exiting the die e.g. by spraying with tap water. This primary tube is then reheated, and stretched and cooled as taught in the above patents.

EXAMPLE 1

A heat-shrinkable bag according to the present invention, as generally illustrated in FIGS. 1 & 2, is produced from a film comprising a coextruded five-layer biaxially oriented shrink film having from inner surface to outer surface, (A) an inner heat sealing layer, (B) a barrier layer (C) a core layer, (D) a tie layer and (E) an outer heat sealing layer. The inner and outer layers being directly attached to opposing sides of the barrier layer. The five layers included the following composition:

(A) 37 wt. % VLDE; 24% EVA; 33% plastomer (Exact 4053); 6% processing aids;

(B) a blend of about 85% vinylidene chloride-vinyl chloride copolymer and about 15% vinylidene chloride-methacrylate copolymer;

(C) 100 wt. % EMA (D) 20 wt. % VLDPE; 33% plastomer (Exact 4053) and 20 wt. % polybutylene; and, (E) 40 wt. % VLDPE; 33% plastomer (Exact 4053); 25% EVA; 2% processing air.

One extruder was used for each layer. Each extruder was connected to an annular coextrusion die from which heat plastified resins were coextruded forming a primary tube. The resin mixture for each layer was fed from a hopper into an attached single screw extruder where the mixture was heat plastified and extruded through a five-layer coextrusion die into the primary tube under conditions similar to those disclosed in copending U.S. application Ser. No. 10/371,950.

Although not essential, it is preferred to irradiate the entire film to broaden the heat sealing range and/or enhance the toughness properties of the inner and outer layers by irradiation induced cross-linking and/or scission. This is preferably done by irradiation with an election beam at dosage level of at least about 2 megarads (MR) and preferably in the range of 3-5 MR, although higher dosages may be employed especially for thicker films or where the primary tube is irradiated. Irradiation may be done on the primary tube or after biaxial orientation. The latter, called post-irradiation, is preferred and described in Lustig et al. U.S. Pat. No. 4,737,391, which is hereby incorporated by reference. An advantage of post-irradiation is that a relatively thin film is treated instead of the relatively thick primary tube, thereby reducing the power requirement for a given treatment level.

The film is unwound and slit to a desired width. The film is then fed into the bag making equipment to form a tube member having a continuous longitudinally extending lap seal. Bags according to the bag 15*a* depicted in FIG. 5 may be formed by sealing laterally across the tube member and simultaneously severing the sealed portion from the continuous tube structure.

Various tests may be performed on the resultant inventive bags. The gauge thickness will typically be a film thickness of less than 10 mil, and preferably between 1.25 to 5.0 mil. The lap seal should typically have an average seal strength of at least 2 kilograms per inch. However, a peelable lap seal may have an average seal strength of greater than 3 kilograms per inch or even of greater than 6 kilograms per inch. At the same time the lap seal provides this strong seal, it may also have an average peelable seal strength of less than 2 kilograms for a one inch strip or of less then 1.5 kilograms for a one inch strip or of about 500 grams to about 1000 grams for a one inch strip. For example. a peelable lap seal may have an average peelable seal strength of less than 2 kilograms for a one inch strip or may have an average peelable seal strength of less than 1.5 kilograms for a one inch strip. The end seal will typically have an average seal strength of at least 3 kilograms. The bag will also have an average M.D. and T.D. heat shrinkability at 90° C. of at least 20%, and preferably at least 40% in both directions, respectively. This preferred bag will have very good heat shrink percentages which are highly desirable for packaging cuts of fresh red meat and also have extremely good puncture resistance, yet advantageously incorporates a peelable seal heretofore not seen in individual food packaging bags. Thus an economical to produce, heat shrinkable bag, having a peelable seal, puncture resistance and strong end seals is provided having a unique combination of features and commercial advantages previously unknown.

The present invention advantageously provides an individual heat-shrinkable bag having an easily peelable seal. Thus, the receptacles or bags of the present invention may be easily opened without resort to a knife or other cutting/opening instrument, which allows food producers to offer a desirable, consumer-friendly package.

Another preferred embodiment of the present invention uses a 7-layer heat shrinkable film to produce backseamed material. This 7-layer film has several advantages over 3 and 5 layer structures. Use of a polymeric having a high melt index greater than 2.0 dg/10 min, e.g., an ethylene α-olefin copolymer such as Exact 4053 in the sealant layers helps seal through creases and wrinkles in the seal. This is important as the overlapped area creates a crease in the seal.

Another advantage is use of a strong adhesive polymer, e.g., an ethylene methylacrylate copolymer (EMA) such as Emact SP 1330 (which reportedly has: a density of 0.948 g/cm$^3$; melt index of 2.0 g/10 min.; a melting point of 93° C.; is at softening point of 49° C.; and a methylacrylate (MA) content of 22% as a PVDC tie layer to give improved adhesion. This has been shown to give a superior bond strength. EMA gives bonds over 100 g in the finished film. A preferred 7-layer structure has a first heat seal layer comprising an ethylene α-olefin copolymer (Exxon Exact 3139), a second peelable tie layer comprising a polymeric blend having between 15 to 35% each of EVA (Exxon 701.ID); ethylene butene-1 copolymer (Exxon Exact 4053); ethylene octene-1 copolymer (Nova VLDPE 10B) and a third tie layer, e.g., comprising EMA (Voridian SP 1330); a fourth barrier layer, e.g., as described above in Example 1; a fifth tie layer, e.g., comprising EMA; a sixth intermediate layer comprising a blend of 20-45% each of EVA ethylene-butene-1 copolymer and ethylene-octene-1 copolymer; and a seventh outer surface layer comprising an ethylene α-olefin copolymer, e.g., Exxon Exact 3139.

The above film is preferably 2 mils thick overall and has a layer thickness ratio for the first through seventh layers, respectively of 10:42:5:18:5:15:5.

The bags 15, 15*a*, 15*b*, 15*c* and 15*d* may be fabricated of nearly any dimensions economically since the bags are not formed from a seamless tube that must be generated to the desired width. The only limitation on size of fabricated bag is the size of rollstock films. Standard roll stock films are available in widths in excess of 100 inches. The present invention allows a bag manufacturer to fabricate any size bag from the same flat sheet of roll stock, up to the dimensional limits of the roll stock. For example, if the roll stock is 52 inches in width, a tube member can be fabricated having a lay-flat width of approximately 26 inches, taking into account the amount of overlap, gap or abutment in the first seal 16, 116, 216 and 316 used. For example, if the manufacturer wishes to fabricate a lap seal or fin seal bag having a lay-flat width of 18 inches, then the manufacturer slits the standard roll stock to the appropriate width (approximately 36 plus extra for the area of the first seal 16 or 116). The unused portion slit form the standard roll stock is rewound for use making bags of another dimension(s). In this manner, standard roll stock films can be manufactured more economically because film manufacturing equipment may be run at or near the upper limits of film width production and thereby use nearly all the equipments capacity. Fabricating bags from seamless tubes requires that the film making equipment be run at limited capacities to form the different smaller width tubes. Additionally, the film making equipment requires costly set-up and breakdown between jobs of differing dimensions that add significantly to the cost of manufacturing the seamless tubes.

An easily peelable heat shrinkable film has been described above with respect to end sealed bags having seamless sides, it should be readily apparent in view of the present disclosure that side seal heat shrinkable bags and pouches made from a plurality of films may also be adapted to the present invention to provide easy to peel open heat shrinkable receptacle. The present invention may be utilized with heat shrinkable formed into a pouch as described in U.S. Pat. No. 6,015,235 (Kraimer, et al.) and U.S. Pat. No. 6,206,569 (Kraimer, et al.) whose teachings are incorporated herein by reference.

While this invention has been described with reference to certain specific embodiments, it will be recognized by those skilled in the art that many variations are possible without departing from the scope and spirit of the invention and such variations are deemed to be within the scope of the invention claimed below.

What is claimed is:

1. An individual, end-sealed packaging bag formed from a sheet of a heat-shrinkable film, said sheet of a heat-shrinkable film having a first side, an opposing second side, an inner surface and an outer surface, said bag comprising:

a first seal connecting said first side to said second side and defining a tube member having a first bag wall, a second bag wall, opposing first and second bag edges, an end and an open mouth opposite said end;

a second seal provided through said first and second bag walls, said second seal extending laterally across the width of both said first and second bag walls at a position proximate said end, whereby an empty product receiving chamber is defined by said first bag wall, said second bag wall, said second seal and said open mouth; and, wherein said first seal comprises a peelable seal and is selected from the group consisting of a lap seal, a butt-seal tape and a seal strip; wherein said sheet of heat-shrinkable film comprises a biaxially stretched film having a shrinkage value of at least 20% shrink at 90° C. in at least one direction; and wherein said sheet of heat-shrinkable film comprises a multilayer film which includes a peelable system adapted to peel at an interior layer of said film.

2. The bag according to claim 1, wherein said butt-seal tape has a first border and a second border, a first heat seal joining said first border to said first side, and a second heat seal joining said second border to said second side.

3. The bag according to claim 2, wherein said first and second heat seals are peelable.

4. The bag according to claim 3, wherein said butt-seal tape comprises a butt-seal film including a peelable system.

5. The bag according to claim 2, wherein said butt-seal tape includes a pull flap.

6. The bag according to claim 2, wherein said first border is heat sealed to the inner surface of said first side and said second border is heat sealed to the inner surface of said second side.

7. The bag according to claim 6, wherein at least one of said first and second sides extends outwardly to form a pull flap.

8. The bag according to claim 1, wherein said seal strip comprises a strip film having a first margin, a second margin, an inside surface and an outward surface; a first heat seal joining said outward surface of said first margin to said inner surface of said first side; and a second heat seal joining said inside surface of said strip film to said outer surface of said second side.

9. The bag according to claim 8, wherein said second heat seal is a peelable seal.

10. The bag according to claim 8, wherein said first heat seal is a peelable seal.

11. The bag according to claim 8, wherein said strip film comprises a peelable system.

12. The bag according to claim 8, wherein said strip film includes a pull flap.

13. The bag according to claim 1, wherein said multilayer film comprises a multilayer barrier film.

14. The bag according to claim 13, wherein said multilayer barrier film comprises:

(a) an inner heat sealing layer;

(b) a barrier layer;

(c) a core layer;

(d) a tie layer; and, (e) an outer heat sealing layer.

15. The bag according to claim 1, wherein said first seal has a peelable seal strength of less than 2 kilograms for a one inch strip.

16. The bag according to claim 1, wherein said first seal has a peelable seal strength of less than 1.5 kilograms for a one inch strip.

17. The bag according to claim 14, wherein said outer heat sealing layer forms the outer surface of said bag.

18. The bag according to claim 14, wherein said tie layer is permanently bonded to said core layer and peelably bonded to said outer heat sealing layer.

19. The bag according to claim 14, wherein said tie layer is permanently bonded to said outer heat sealing layer and peelably bonded to said core layer.

20. The bag according to claim 14, wherein said tie layer comprises a blend of polybutylene and at least one other constituent.

21. The bag according to claim 14, wherein said at least one other constituent comprises polyethylene.

22. The bag according to claim 14, wherein said outer heat sealing layer comprises polyethylene.

23. The bag according to claim 14, wherein said core layer comprises a blend of polyethylene and an ethylene-vinyl acetate copolymer.

24. The bag according to claim 14, wherein said barrier layer is selected from the group consisting of vinylidene chloride copolymers, ethylene vinyl alcohol copolymers, polyacrylonitriles and polyamides.

25. The bag according to claim 24, wherein said barrier layer comprises a vinylidene chloride copolymer.

26. The bag according to claim 14, wherein said inner heat sealing layer comprises a blend of polyethylene and ethylene-vinyl acetate copolymer.

27. The bag according to claim 14, wherein said tie layer comprises a blend of polybutylene and at least one other constituent; said outer heat sealing layer comprises polyethylene; said core layer comprises a blend of polyethylene and an ethylene-vinyl acetate copolymer; said barrier layer comprises a vinylidene chloride copolymer; and said inner heat sealing layer comprises a blend of polyethylene and ethylene-vinyl acetate copolymer.

28. The bag according to claim 27, wherein said at least one other constituent comprises polyethylene and said barrier layer comprises a blend of vinylidene chloride-methyl acrylate copolymer and vinylidene chloride-vinyl chloride copolymer.

29. The bag, according to claim 14, wherein said inner heat sealing layer comprises less than 50%; said barrier layer comprises less than about 20%; said core layer comprises less than 28%; said tie layer comprises less than about 15%; and said outer heat sealing layer comprises less than 15%; based on the total thickness of said film.

30. The bag according to claim 1, wherein said second seal is nonpeelable.

31. The bag according to claim 1, wherein said sheet of heat-shrinkable film has a thickness from about 1.25 mil to about 8.0 mil.

32. The bag according to claim 31, wherein said sheet of heat-shrinkable film has a thickness from about 1.75 mil to about 3.0 mil.

33. The bag according to claim 1 wherein said shrinkage value is in the machine direction.

34. The bag according to claim 1, wherein said shrinkage value is in the transverse direction.

35. The bag according to claim 1, wherein said shrinkage value is in both the machine direction and the transverse direction.

36. The bag according to claim 14, wherein said first seal comprises a lap seal and said inner heat sealing layer forms the inside surface of the bag.

37. The bag according to claim 1, wherein said first seal comprises a lap seal and said first side includes an unsealed portion extending outwardly beyond said first seal.

38. An end-sealed packaging bag formed from a sheet of a heat-shrinkable film, said film having a first side and an opposing second side, said bag comprising:

a first seal bonding said first side and said second side along the lengths thereof thereby defining a tube member having a first bag wall, a second bag wall, opposing first and second bag edges, an end and an open mouth, said first seal comprising a lap seal and being peelable;

a second seal provided through said first and second walls, said second seal extending laterally across the width of both said first and second walls at a position approximate said end and said second seal being nonpeelable; and, a product receiving chamber defined by said first wall, said second wall, said second seal and said open mouth;

wherein said sheet of heat-shrinkable film comprises a biaxially stretched film having a shrinkage value of at least 20% shrink at 90° C. in at least one direction; and wherein said sheet of heat-shrinkable film comprises a multilayer film which includes a peelable system adapted to peel at an interior layer of said film.

39. An end-sealed packaging bag formed from a sheet of a heat-shrinkable film, said film having a first side, an opposing second side, an inner surface and an outer surface and said film comprising a multilayer barrier film, said bag comprising:

a first seal joining said first side and said second side along the lengths thereof, wherein such first seal is continuous and defines a tube member having a first bag wall, a second bag wall, opposing first and second bag edges, an end and an open mouth, said first seal comprising a lap seal and being peelable and having a peelable seal strength of less than 2 kilograms for a one inch strip;

a second seal provided through said first and second walls, said second seal extending laterally across the width of both said first and second walls at a position approximate said end and said second seal having a seal strength of greater than 3 kilograms per inch; and, a product receiving chamber defined by said first wall, said second wall, said second seal and said open mouth;

wherein said sheet of heat-shrinkable film comprises a biaxially stretched film having a shrinkage value of at least 20% shrink at 90° C. in at least one direction; and wherein said sheet of heat-shrinkable film includes a peelable system adapted to peel at an interior layer of said film.

40. The bag according to claim 39, wherein said multilayer barrier film comprises (a) an inner heat sealing layer;

(b) a barrier layer adjacent said inner heat sealing layer;

(c) a core layer adjacent said barrier layer (d) a tie layer adjacent said core layer; and, (e) an outer heat sealing layer adjacent said tie layer.

41. The bag according to claim 40, wherein said tie layer comprises a blend of polybutylene and at least one other constituent.

42. The bag according to claim 41, wherein said at least one other constituent comprises polyethylene.

43. The bag according to claim 40, wherein said outer heat sealing layer comprises polyethylene.

44. The bag according to claim 40, wherein said core layer comprises a blend of polyethylene and an ethylene-vinyl acetate copolymer.

45. The bag according to claim 40, wherein said barrier layer is selected from the group consisting of vinylidene chloride copolymers, ethylene vinyl alcohol copolymers, polyacrylonitriles and polyamides.

46. The bag according to claim 45, wherein said barrier layer comprises a vinylidene chloride copolymer.

47. The bag according to claim 40, wherein said inner heat sealing layer comprises a blend of polyethylene and ethylene-vinyl acetate copolymer.

48. The bag according to claim 40, wherein said tie layer comprises a blend of polybutylene and at least one other constituent; said outer heat sealing layer comprises polyethylene; said core layer comprises a blend of polyethylene and an ethylene-vinyl acetate copolymer; said barrier layer comprises a vinylidene chloride copolymer; and said inner heat sealing layer comprises a blend of polyethylene and ethylene-vinyl acetate copolymer.

49. The bag according to claim 48, wherein said at least one other constituent comprises polyethylene and said barrier layer comprises a blend of vinylidene chloride-methyl acrylate copolymer and vinylidene chloride-vinyl chloride copolymer.

50. The bag according to claim 40, wherein said inner heat sealing layer comprises less than 50%; said barrier layer comprises less than about 20%; said core layer comprises less than 28%; said tie layer comprises less than about 15%; and said outer heat sealing layer comprises less than 15%; based on the total thickness of said film.

51. The bag according to claim 1, wherein said first seal has a seal strength of greater than 3 kilograms per inch.

52. The bag according to claim 1, wherein said first seal has a seal strength of greater than 6 kilograms per inch.

53. The bag according to claim 1, wherein said second seal has a seal strength of greater than 3 kilograms per inch.

54. The bag according to claim 40, wherein said outer heat sealing layer forms the outer surface of said bag.

55. The bag according to claim 40, wherein said tie layer is permanently bonded to said core layer and peelably bonded to said outer heat sealing layer.

56. The bag according to claim 40, wherein said tie layer is permanently bonded to said outer heat sealing layer and peelably bonded to said core layer.

57. The bag according to claim 1, wherein said first seal connects said first side to said second side along the lengths thereof and is continuous.

58. The bag according to claim 1, wherein said sheet of heat-shrinkable film comprises an outer layer, an inner heat seal layer and a tie layer disposed between said outer layer and said inner heat seal layer, and said film is adapted to peel at a location in said tie layer, a location between said tie layer and said outer layer, a location between said tie layer and said inner heat seal layer, or a combination of said locations.

59. The bag according to claim 38, wherein said sheet of heat-shrinkable film comprises an outer layer, an inner heat seal layer and a tie layer disposed between said outer layer and said inner heat seal layer, and said film is adapted to peel at a location in said tie layer, a location between said tie layer and said outer layer, a location between said tie layer and said inner heat seal layer, or a combination of said locations.

60. The bag according to claim 39, wherein said sheet of heat-shrinkable film comprises an outer layer, an inner heat seal layer and a tie layer disposed between said outer layer and said inner heat seal layer, and said film is adapted to peel at a location in said tie layer, a location between said tie layer and said outer layer, a location between said tie layer and said inner heat seal layer, or a combination of said locations.

* * * * *

UNITED STATES PATENT AND TRADEMARK OFFICE

CERTIFICATE OF CORRECTION

PATENT NO. : 7,527,839 B2
APPLICATION NO. : 10/645186
DATED : May 5, 2009
INVENTOR(S) : David A. Busche et al.

It is certified that error appears in the above-identified patent and that said Letters Patent is hereby corrected as shown below:

In the Drawings
On Sheet 3 of 8, in FIG. 7, insert -- 41 -- as shown on attached sheet.
On Sheet 8 of 8, in FIG. 16, delete "116" and insert -- 11b --.

In the Specification
In column 2, line 67, delete "FIG. 6" and insert -- FIG. 5 --.
In column 3, line 11, delete "FIG. 1" and insert -- FIG. 11 --.
In column 6, line 53, delete "(EVA," and insert -- (EVA), --.
In column 7, line 17, delete "product" and insert -- produce --.
In column 7, line 58, delete "member 19" and insert -- member 18 --.
In column 10, line 38, delete "(FIG. 2)" and insert -- (FIG. 3) --.
In column 10, line 57, delete "15" and insert -- 33 --; delete "12" and insert -- 30*a* -- and; delete "14" and insert -- 30*b* --.
In column 10, line 59, delete "10*c*" and insert -- 15*c* --.
In column 11, line 17, delete "second heat seal 20" and insert -- first heat seal 320 --.
In column 12, line 37, delete "76μ" and insert -- 76μm --.
In column 15, line 29, delete "election" and insert -- electron --.

In the Claims
In column 18, line 38, in claim 21, delete "14" and insert -- 20 --.

Signed and Sealed this
Fifteenth Day of March, 2016

Michelle K. Lee

Michelle K. Lee
*Director of the United States Patent and Trademark Office*